US006932726B2

(12) United States Patent
Hamilton

(10) Patent No.: US 6,932,726 B2
(45) Date of Patent: Aug. 23, 2005

(54) VOLLEYBALL NET PRETENSIONED WITH RIGID SIDE STRIPS

(75) Inventor: Roy Stanley Hamilton, Dorval (CA)

(73) Assignee: Seaway Plastics Ltd., Lachine (CA)

( * ) Notice: Subject to any disclaimer, the term of this patent is extended or adjusted under 35 U.S.C. 154(b) by 271 days.

(21) Appl. No.: 10/465,561

(22) Filed: Jun. 20, 2003

(65) Prior Publication Data

US 2004/0259668 A1 Dec. 23, 2004

(51) Int. Cl.[7] ..... A63B 61/00
(52) U.S. Cl. ..... 473/494
(58) Field of Search ..... 473/473, 474, 473/490, 492, 494

(56) References Cited

U.S. PATENT DOCUMENTS

| | | | | | |
|---|---|---|---|---|---|
| 2,408,308 | A | * | 9/1946 | Grabowsky | 28/143 |
| 2,610,852 | A | * | 9/1952 | Ederer | 112/416 |
| 3,649,011 | A | * | 3/1972 | Barnes | 473/494 |
| 3,940,139 | A | | 2/1976 | Barnes | |
| 4,997,185 | A | * | 3/1991 | Bartasius | 473/492 |
| 5,303,932 | A | | 4/1994 | Kessler | |
| 5,320,344 | A | * | 6/1994 | Henderson | 473/494 |
| 5,344,157 | A | | 9/1994 | McCord | |
| 5,358,257 | A | | 10/1994 | Pardi | |
| 5,651,552 | A | | 7/1997 | Whelchel | |
| 5,954,308 | A | | 9/1999 | Lane et al. | |
| 6,461,258 | B1 | | 10/2002 | Vacanti | |
| 6,716,123 | B1 | * | 4/2004 | Chen | 473/490 |
| 2004/0259668 | A1 | * | 12/2004 | Hamilton | 473/473 |
| 2004/0259669 | A1 | * | 12/2004 | Hamilton | 473/473 |

* cited by examiner

*Primary Examiner*—Raleigh W. Chiu
(74) *Attorney, Agent, or Firm*—Ogilvy Renault LLP

(57) ABSTRACT

A volleyball game net or the like includes an elongate and rectangular net having rigid side marginal strips attached to its opposed sides. Each rigid side marginal strip includes a closed hollow body having a closed hollow cross-sectional configuration at an outer side thereof for reinforcing the structure, and an open hollow cross-sectional configuration at an inner side thereof for receiving one side of the net. The side of the net is secured to the hollow body by a lock member or a plurality of pins in a manner such that the net can be substantially evenly tensioned while being supported in a tensioned condition. The rigid side marginal strip can be easily and conveniently attached to the net and provides an aesthetically pleasing presentation to the net assembly.

9 Claims, 5 Drawing Sheets

VOLLEYBALL NET PRETENSIONED WITH RIGID SIDE STRIPS

FIELD OF THE INVENTION

The present invention relates to a net adapted to be supported in a tensioned condition for sports games, and more particularly to an apparatus for attaching to the opposed side ends of a rectangular game net adapted to be supported in a tensioned condition, thereby forming rigid side marginal strips of the net.

BACKGROUND OF THE INVENTION

Volleyball is a popular sports game. It can be played both indoors and outdoors, and at all levels from recreational to professional. Regardless of the level of competition, a volleyball game requires relatively simple equipment such as a net, means for supporting the net and a volleyball.

In accordance with volleyball rules, the net is 1 meter wide and 32 ft long with 4" square mesh construction. A 2" wide band at the top of the net is required. A ¼" support cable generally runs through a fold of the band. Support cables are used to fasten the net to the support means such that the volleyball net is highly tensioned in a horizontal plane at both top and bottom edges, and also in a vertical direction, to form a flat rectangular configuration. It is also important that the net sustain a substantially consistent tension at all points, and retain this consistent tension throughout a volleyball game because in the course of play the ball may be played off of the net. These requirements for tensioning have raised particular problems which have been intensively addressed by the prior art.

It is well known in the art that the use of rigid side marginal strips effectively provides the net with a symmetrical and square profile and effectively maintains a substantially consistent tension at all points of the net when the net is appropriately supported in a tensioned condition. For example, in U.S. Pat. No. 5,358,257, issued to Pardi on Oct. 25, 1994 discloses a volleyball game net having side edges which are made rigid by means such as reinforcing rods within the marginal tapes. U.S. Pat. No. 5,651,552, issued to Whelchel on Jul. 29, 1997 discloses a net attachment and tensioning system for a volleyball net which includes a tensioning bar vertically and fixedly attached to a side sleeve of the net. Each tensioning bar is constructed of two flat rectangular members held parallel to each other and spaced apart by a pair of rivets and a plurality of sheaves. U.S. Pat. No. 5,344,157, which issued to McCord on Sep. 6, 1994 discloses a portable volleyball net assembly which includes vertical edges each of which is secured along the entire length by means of a binder or sleeve, to a tubular net cylinder. The tubular net cylinder is attached to the net support posts.

However, those rigid side marginal strips disclosed in the prior art cannot be very conveniently and quickly attached to the side ends of the net. For example, sleeves usually need to be fabricated and attached to the side ends of the net before the reinforcing rod or other element is attached to the side ends of the net. The tubular net cylinder disclosed by McCord rigidly reinforces the side ends of a volleyball net, however it does not actually form a side marginal border of the net due to its bulky configuration relative to the light and flexible net configuration. Therefore, there is a need for an apparatus which can be conveniently and quickly attached to side ends of a volleyball game net or similar nets for other sports games in order to form a rigid side marginal strip of the net.

SUMMARY OF THE INVENTION

One object of the present invention is to provide a rectangular net having rigid side marginal strips, thereby achieving flatness and rigidity of the net while being supported in a tensioned condition.

Another object of the present invention is to provide an apparatus to be attached to one of opposed side ends of a rectangular game net adapted to be supported in a tensioned condition, thereby forming a rigid side marginal strip of the net.

In accordance with one aspect of the present invention, there is a net provided to be supported in a tensioned condition for sports games, which comprises a flexible upper edging and a flexible lower edging both extending in a substantially horizontal direction and opposed rigid side marginal strips, both extending in a substantially vertical direction. A plurality of equally spaced horizontal strands extend between opposed rigid side marginal strips, and a plurality of equally spaced vertical strands extend between the upper and lower edgings, thereby defining a plurality of mesh opening of the net. Each of the rigid side marginal strips includes an elongate, substantially flat and rigid hollow body for receiving an outer-most vertical strand disposed at one side of the net, and securing means for passing through every mesh opening adjacent to the outer-most vertical strand and being secured to the rigid hollow body.

In accordance with another aspect of the present invention there is provided an apparatus to be attached to one of the opposed side ends of a rectangular game net which is adapted to be supported in a tensioned condition, forming a rigid side marginal strip of the net. The apparatus comprises an elongate, substantially flat and rigid hollow body including open upper and lower ends, and two spaced-apart major walls extending between the upper and lower ends and defining a closed hollow cross-sectional configuration at an external side thereof for reinforcing the body and an open hollow cross-sectional configuration and inner side thereof for receiving one side end of the net. The apparatus further includes securing means for securing the side end of the net within the open hollow cross-sectional configuration in a manner such that the net can be substantially evenly tensioned while being supported in a tensioned condition.

In one embodiment of the present invention the open hollow cross-sectional configuration of the hollow body comprises a pair of stop members extending from the respective major walls towards each other in a spaced-apart relationship, and an elongate opening extending along the entire length of the body from the upper end to the lower end, permitting the outer-most vertical strand and the connected sections of the horizontal strands to enter therethrough into the inside of the open hollow cross-sectional configuration. The securing means comprise an elongate lock member having a plurality of spaced slots extending inwardly from one side thereof for receiving the respective horizontal strands to extend therethrough. The lock member holds that outer-most vertical strand and is snugly disposed between the respective major walls and abuts the stop members.

The open hollow cross-sectional configuration of the hollow body according to another embodiment of the present invention comprises a plurality of spaced openings in the respective major walls and an elongate opening extending along the entire length of the body from the upper end to the lower end, permitting the outer-most vertical strand and connected section of the horizontal strands to enter therethrough into the inside of the open hollow cross-sectional configuration. The securing means comprise a plurality of pins extending through every mesh opening adjacent to the outer-most vertical strand and being received at opposed ends thereof in the individual openings in the respective major walls.

In accordance with a further embodiment of the present invention the open hollow cross-sectional configuration of the hollow body comprises a plurality of spaced openings in one of the major walls, and an elongate opening in the other of the major walls extending along the entire length of the body from the upper end to the lower end. A plurality of spaced slots are defined in the other of the two major walls and extend substantially horizontally from the elongate opening towards the inner side of the body, thereby permitting that outer-most vertical strand and its connected sections of the horizontal strands to enter into the inside of the open hollow cross-sectional configuration. The securing means comprise a plurality of spaced pins extending through the respective openings in one of the major walls, through every mesh opening adjacent to that outer-most vertical strand, and through the elongate opening in the other of the major walls. A pair of elongate plates abutting the respective major walls at an outer surface thereof, are secured to the pins at opposed ends thereof to hold the pins in position.

The substantially flat and hollow body is preferably made of extruded aluminium or molded plastics, and is therefore convenient and allows low cost production for large quantities. It is relatively easy to attach the rigid side marginal strip to the net, particularly when the embodiment having the elongate lock member is used. The rigid side marginal strips of the present invention are light in weight and provide an esthetically pleasing presentation which is integrally incorporated into the net profile. More importantly, the rigid side marginal strips attached to the net provide the flatness and the rigidity to the net which are required to achieve the substantially evenly tensioned condition while the net is supported in such a tensioned condition, for example for volleyball games, tennis, badminton, etc.

BRIEF DESCRIPTION OF THE DRAWINGS

Having thus generally described the nature of the present invention, reference will now be made to the accompanying drawings, showing by way of illustration the preferred embodiments thereof, in which.

DETAILED DESCRIPTION OF THE PREFERRED EMBODIMENTS

In order to better illustrate the present invention, volleyball nets are taken as examples of the preferred embodiments and are described in detail below. However, it should be noted that other sports game nets which have a rectangular configuration and is supported in a tensioned condition, such as tennis nets, badminton nets, etc. can be adapted to incorporate the present invention.

Figure 1:
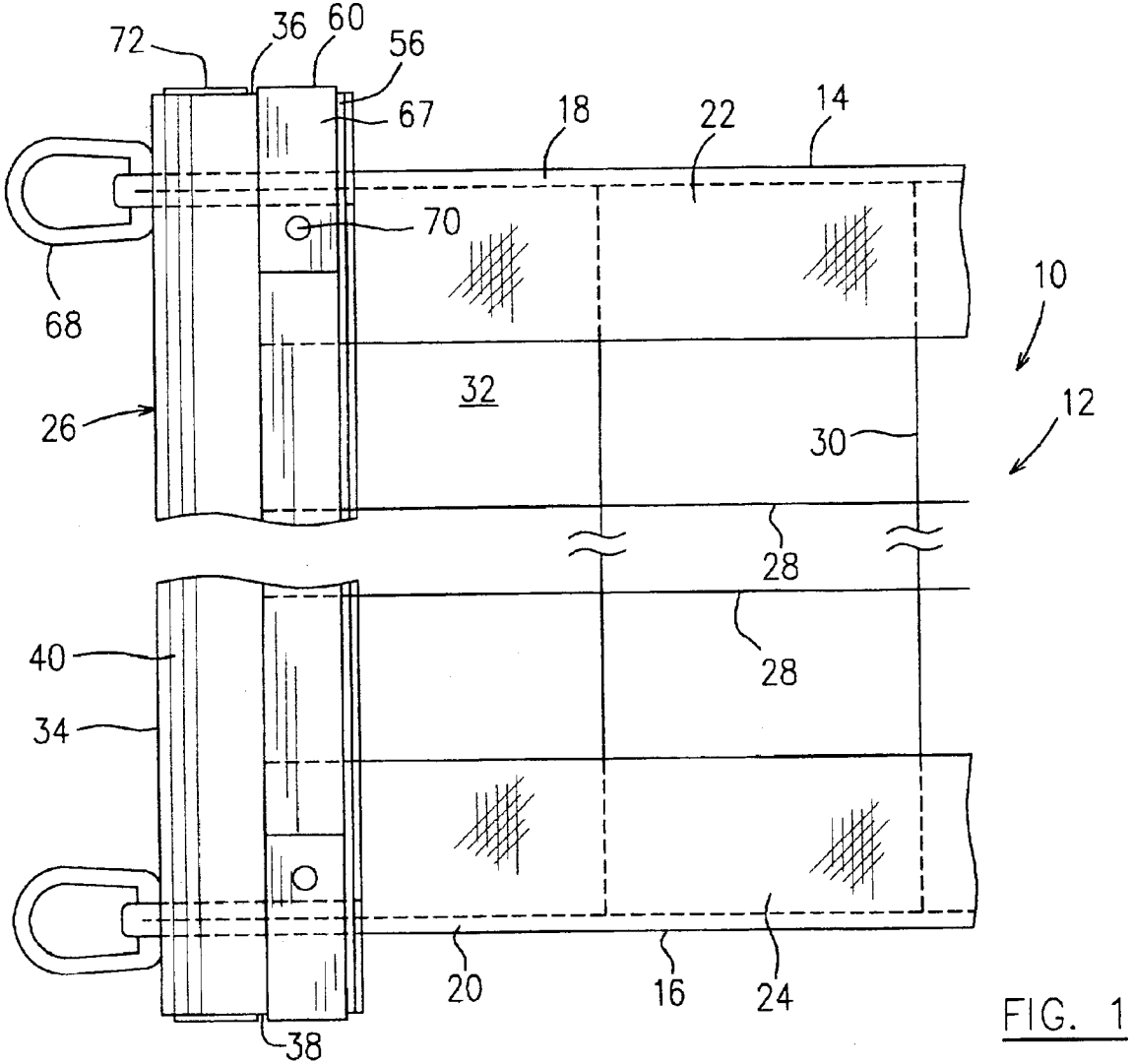
FIG. 1 is a partial side elevational view of a volleyball net assembly incorporating one embodiment of the present invention.
Figure 3:
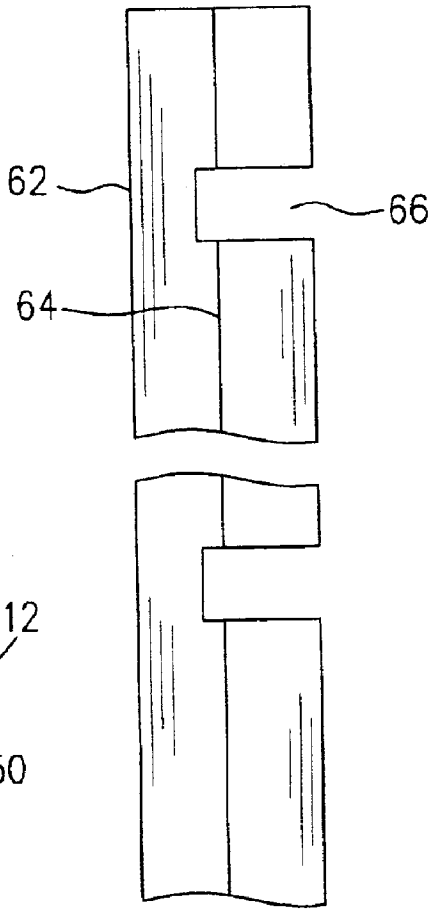
FIG. 3 is a partial side elevational view of a lock member included in the rigid side marginal strip of FIG. 2.
Figure 2:
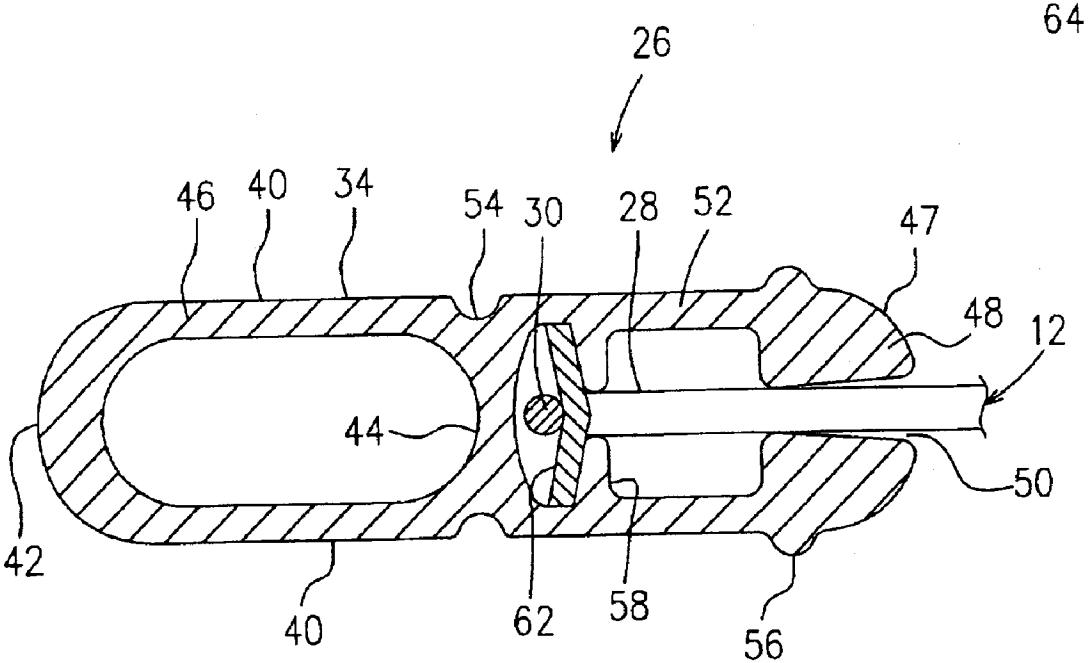
FIG. 2 is a cross-sectional view of a rigid side marginal strip in an enlarged scale, used in the embodiment of FIG. 1.

Referring to FIGS. 1–3, a volleyball net assembly generally indicated by numeral 10, includes an elongated, rectangular net 12 having a flexible upper edge 14 and a flexible lower edge 16, both extending in a substantially horizontal direction when the volleyball net assembly 10 is supported in a tensioned condition. The net assembly 10 is symmetrical about its vertical centerline and its horizontal centerline, and therefore, only a left side thereof is shown in FIG. 1. The flexible upper and lower edges 14, 16 are usually defined by respective upper and lower cables 18, 20 which are each placed in a folded fabric band 22, 24, thereby forming the respective upper and lower edgings of the net 12. At the opposed side ends of the net assembly 10 there is provided a pair of rigid side marginal strips 26 (only one shown), both extending in a substantially vertical direction when the net assembly 10 is supported in the tensioned condition for a game. A plurality of spaced horizontal strands 28 extend between the opposed rigid side marginal strips 26 and a plurality of spaced vertical strands 30 extend between the upper and lower edges 14 and 16 defining a plurality of mesh openings 32 of the net 12.

Each of the rigid side marginal strips 26 includes an elongate, substantially flat and rigid hollow body 34 which is preferably made of extruded aluminium. However other materials can also be used, for example molded plastics. The hollow body 34 includes an open upper end 36, an open lower end 38 and two spaced apart major walls 40 extending between the upper and lower ends 36, 38 thereof. The major walls 40, are interconnected by a curved side wall 42 at one side thereof and by a middle wall 44 at a middle location thereof, thereby defining a closed hollow cross-sectional configuration 46 at that side of the hollow body 34. The major walls 40 at the other side have curved surfaces 47 and include inwardly projecting boss sections 48 which extend along the entire length of the hollow body 34. The inwardly projecting boss sections 48 of the respective major walls 40 are spaced apart and form an elongate passage 50 therebetween which extends through the entire length of the hollow body 34. Thus an open hollow cross-sectional configuration 52 is defined at the other side of the hollow body, which forms an inner side of the hollow body 34 for receiving the outer-most vertical strand 30 at one side of the net 12 and the connected sections of the horizontal strands 28 of the net. The closed hollow cross-sectional configuration 46 forms an outer side of the body 34 for reinforcing the body.

A pair of exterior grooves 54 extend along the entire length of the respective major walls 40 at the middle location thereof, which not only provide an aesthetically pleasing appearance to the body 34 but also reduce the weight thereof and increase the resiliency of the open hollow cross-sectional configuration 52. A pair of external boss sections 56 project outwardly from the respective major walls 40 at the inner side thereof, and extend along the entire length of the body 34, thereby providing an aesthetically pleasing appearance and accommodation for positioning of a cap 60 which is attached to the hollow body 40 at the respective upper and lower ends 36, 38 thereof, and which will be further described below. The hollow body 34 further includes a pair of stop members 58 extending from the respective major walls 40 towards each other in a spaced-apart relationship, and being disposed along the entire length of the body 34.

An elongate lock member 62 is provided to secure the hollow body 34 to the net 12. The lock member 62 includes a relatively rigid metal or plastic band and is slightly bent about its longitudinal center line 64. A plurality of slots 66 are defined in the elongate lock member 62, disposed in a spaced-apart relationship and extending inwardly from one side of the lock member 62. The spacing between the slots 66 are substantially identical to the spacing of the horizontal strands 28 of the net 12 so that the lock member 62 is adapted to hold the outer-most vertical strand 30 abutting the longitudinal middle region of the lock member 62 at the inwardly bent side thereof, and permits the connected sections of the horizontal strands 28 of the net 12 to pass through the respective slots 66. The slots 66 have a depth to permit horizontal strands 28 extending therethrough to intersect the longitudinal center line 64 of the lock member 62 so that the outer-most vertical strand 30 can be appropriately positioned at the longitudinal middle region of the lock member 62.

Each of the stop members 58 has one side which is adapted for abutting the outwardly bent sides of the lock member 62, and this side is angularly inclined in accordance with the bending angle of the lock member 62 such that the lock member 62 firmly abuts the respective stop members 58 when holding the outer-most vertical strand 30 in position.

The lock member 62 is sized such that the lock member 62 is snugly fit between the two major walls 40 and thereby, the friction between the lock member 62 and the respective major walls 40 holds the lock member 62 within the open hollow cross-sectional configuration 52 of the hollow body 34. The length of the lock member 62 is smaller than the width of the net 12 between the upper and the lower edges 14, 16 and the hollow body 34 has a length greater than the width of the net 12. Thus, when the lock member 62 holds the outer-most vertical strand 30 of the net 12 within the open hollow cross-sectional configuration 52 of the hollow body 34, the upper and lower cables 18, 20 extend over the top and lower ends of the lock member 62 and outwardly through openings (not shown) in the middle wall 44 and the side wall 42, in order to be connected to rings 68, respectively. The rings 68 are disposed at the outer side of the hollow body 34, near the respective upper and lower ends 36, 38 thereof, and are used for attachment of other cables or ropes which are tensioningly tied, for example to a post (not shown). The upper and lower cables 18 and 20 are affixed to the either or both side wall 42 and middle wall 44 of the hollow body 34 by well known means (not shown).

The rigid side marginal strip 26 is easily attached to the net 12. The first step of the attachment is to insert the outer-most sections of the horizontal strands 28 into the respective spaced slots 66 of the lock member 62, and position the outer-most vertical strand 30 at this side of the net 12 in the center region of the lock member 62 at the inwardly bent side. The second step of the attachment is to insert the lock member 62 into the open hollow cross-sectional configuration 52, between the middle wall 44 and the stop members 58 such that the outer-most sections of the horizontal strands 28 extend between the spaced stop members 58 and through the passage 50 defined between the major walls 40 at the inner side of the hollow body 34. A hammer may be used to help with the insertion. Thus the portions of the lock member 62 defined between the adjacent slots 66 thereof, pass through every mesh opening 32 which are adjacent to the outer-most vertical strand 30, thereby achieving a substantially even tension on the individual horizontal strands 28 while the entire net assembly 10 is supported in a tensioned condition.

The flexibility of the open hollow cross-sectional configuration, which increases because of the exterior grooves 54, facilitates the insertion of the lock member thereinto without compromising the friction forces required to hold the lock member 62 in position.

Additionally, caps 60 are provided, each being formed by a U-shaped metal or plastic element including two spaced legs 67 (only one shown), such that the cap 60 covers either the upper or lower open end 36, 38 at the inner side of the hollow body 34 while the two legs 67 of each cap 60 are affixed to the respective major walls 40, for example by rivets 70, after the lock member holds the net 12 and is inserted into the open hollow cross-sectional configuration 52 of the hollow body 34. Preferably, two cover plates 72 made of metal or plastic materials can be placed at the respective upper and lower open ends 36, 38 of the hollow body 34, at the outer side thereof in order to cover the open ends of the closed hollow cross-sectional configuration 46 of the hollow body 34.

It should be noted that the spacing between the stop members 58 and between the inwardly projecting bosses 48 of the major walls 40, are sized to permit not only the horizontal strands 28 but also the folded upper and low fabric bands 22, 24, to pass therethrough.

Figure 4:
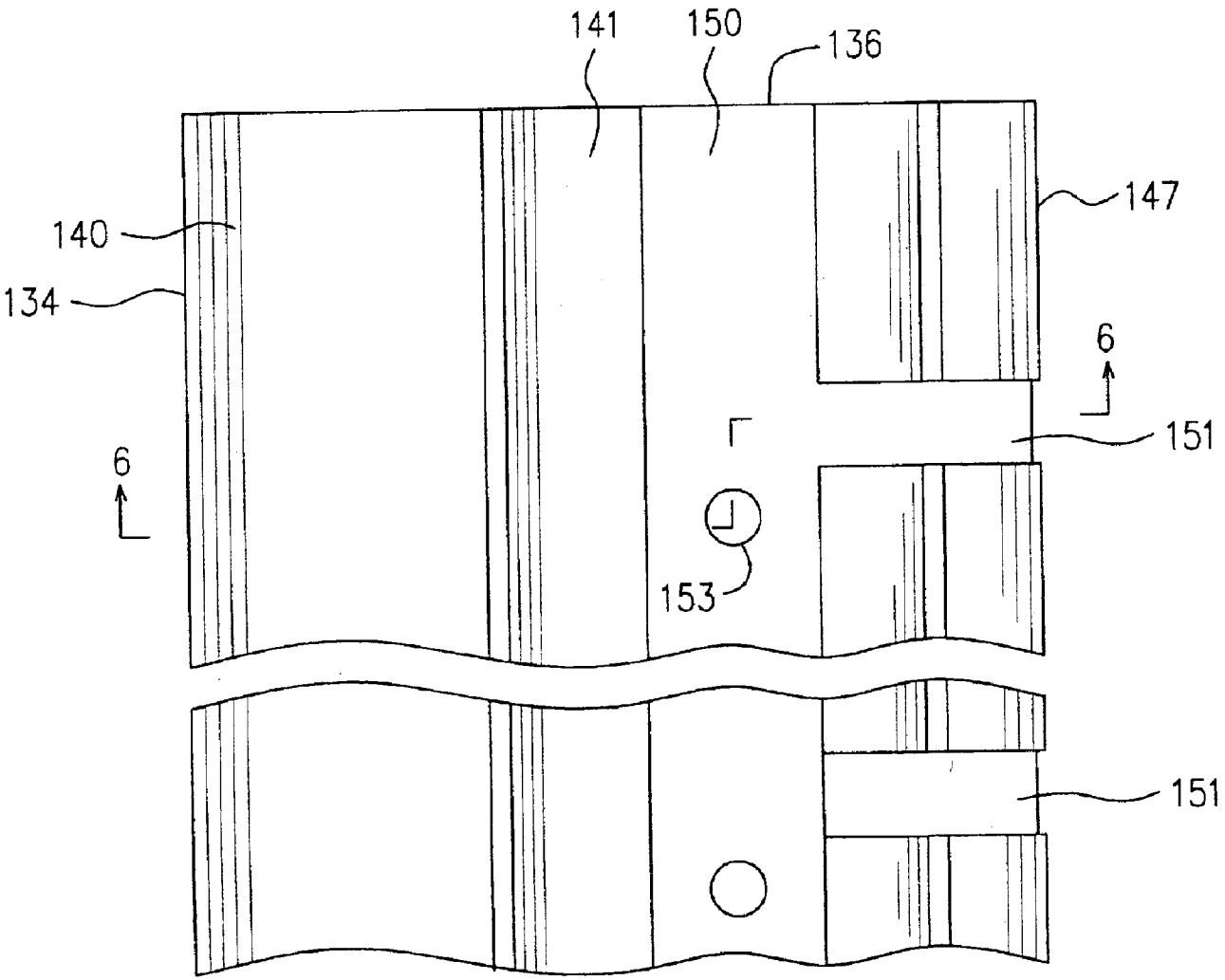
FIG. 4 is a partial side elevational view of a substantially flat hollow body in an enlarged scale, used in another embodiment of the present invention.
Figure 5:
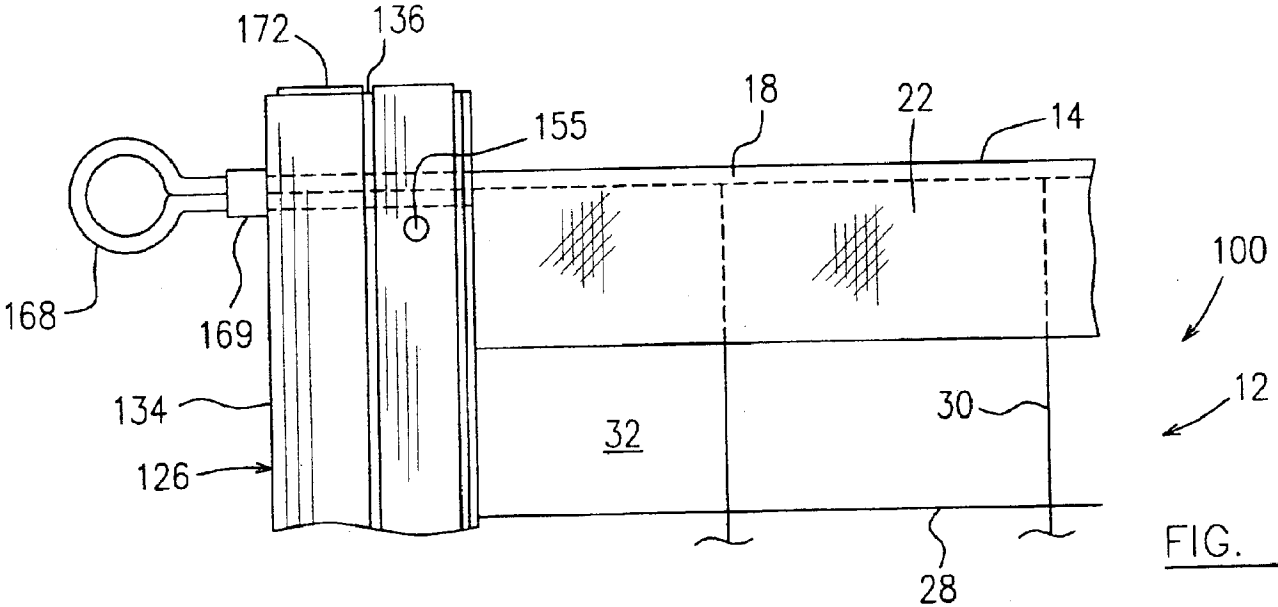
FIG. 5 is a partial side elevational view of a volleyball net assembly incorporating the embodiment which includes the substantially flat hollow body of FIG. 4.
Figure 6:
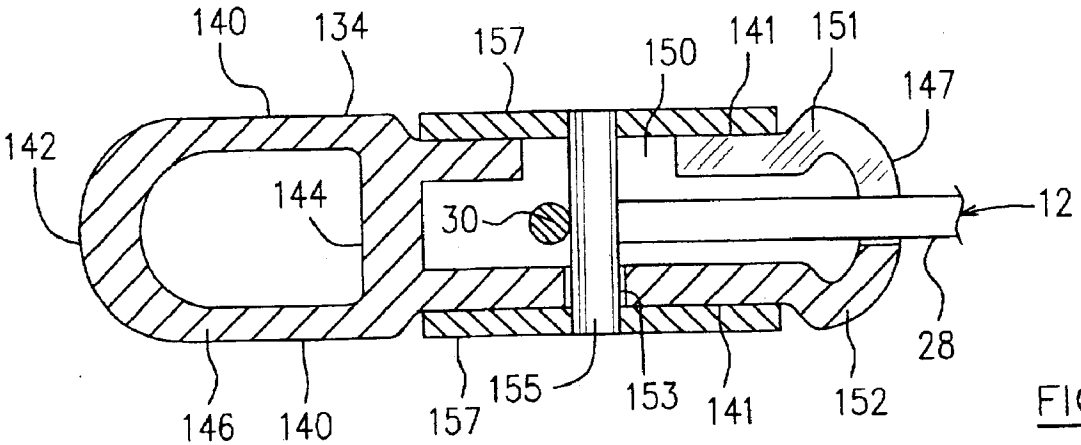
FIG. 6 is cross-sectional view of a rigid side marginal strip in an enlarged scale, used in the volleyball net of FIG. 5.

Referring to FIGS. 4–6, a volleyball net assembly 100 is illustrated according to another embodiment of the present invention. The volleyball net assembly 100 includes an elongate rectangular net which is similar to the net 12 of FIG. 1, and similar components thereof are indicated by similar numerals. The net 12 and its components indicated by those similar numerals will not be redundantly described. The volleyball net assembly 100, similar to the volleyball net assembly 10 of FIG. 1, is symmetrical about its horizontal centerline and its vertical centerline, therefore only an upper and left side portion of the volleyball net assembly 100 is shown in FIG. 5.

The volleyball net assembly 100 further includes a pair of rigid side marginal strips 126 (only one shown) attached to the opposed side ends of the net 12, both extending in a substantially vertical direction while the net assembly 100 is supported in the tensioned position for a game. Each of the rigid side marginal strips 126 includes an elongate, substantially flat and rigid hollow body 134 which is preferably made of extruded aluminium or molded plastic. The hollow body 134 includes an open upper end 136, an open lower end (not shown) and two spaced apart major walls 140 extending between the upper and lower ends thereof. The major walls 140 are interconnected by a curved side wall 142 at the outer side thereof and by a middle wall 144 at a middle location thereof, thereby defining a closed hollow cross-sectional configuration 146 at the outer side of the hollow body 134. The major walls 140 at the inner side of the hollow body 134 are interconnected by a curved side wall 147. The major walls 140 are each inwardly recessed at an area 141 situated between the middle wall 144 and the curved side wall 147. An elongate opening 150 is defined within the recessed area 141 of one of the major walls 140, and extends throughout the entire length of the hollow body 134, between the upper and lower ends thereof. Thus, an open hollow cross-sectional configuration 152 is defined at the inner side of the hollow body 134. A plurality of spaced slots 151 extend from the elongate opening 150 in a substantially horizontal direction toward the inner side of the hollow body 134, extending through the recessed area 141 of the major wall 140 and into the curved side wall 147. The spacing between the adjacent slots 151 is substantially equal to the spacing between the horizontal strands 28 of the net 12, such that the outer-most sections of the horizontal strands 28 connected to the outer-most vertical strand 30 is permitted to pass through the individual slots 151 when the outer-most vertical strand 30 enters the open hollow cross-sectional configuration 152 of the hollow body 134 through the elongate opening 150.

A plurality of spaced openings 153 (only one shown) are provided in the recessed area 141 of the major wall 140 which does not include the elongate opening 150. The openings 153 are aligned with the elongate opening 150 and the spacing between the adjacent openings 153 is substantially equal to the spacing between the adjacent horizontal strands 28 of the net 12. The vertical locations of the spaced openings 153 should be offset from the vertical locations of the spaced slots 151, as shown in FIG. 4. Thus, a plurality of pins 155 extending through the individual openings 153 can pass through every mesh opening adjacent to the outer-most vertical strand 30 and further through the elongate openings 150. Individual pins 155 are secured at the opposed ends thereof by a pair of elongate plates 157. Each elongate plate 157 has a plurality of corresponding openings (not indicated) for snugly receiving the pins 155, and abuts the recessed area 141 of the major wall 140. In order to show the cross-section of both the opening 153 and the slot 151, the cross-sectional view of FIG. 6 represents the cross-section taken along line 6—6 of FIG. 4, while the hollow body 134 of FIG. 4 is attached to the net 12, as shown in FIG. 6.

In order to attach the rigid side marginal strip 126 to the net 12, the pins are secured at one side thereof to one of the elongate plates 157, and extend through the respective openings 153 in the hollow body 134 until the attached plate 157 abuts the recessed area 141 of the major walls 140 having the openings 153. The outer-most vertical strand 30 of the net 12 is then positioned at the left side of the pins 155, and the horizontal strands 28 are aligned with the spaced slots 151. Thus, the outer-most vertical strand 30 and the connected sections of the horizontal strands 28 can be moved into the open hollow cross-sectional configuration 152 through the elongate opening 150 and the spaced slots 151 in order to permit the spaced pins 155 to pass through every mesh opening 32 adjacent to the outer-most vertical strand 30. The second elongate plate 157 is then placed in position to secure the other end of the spaced pins 155, and abuts the recessed area 141 of the second major wall 140, thereby closing the elongate openings 150. The upper cable 18, the end of which is folded to form a ring 168, extends outwardly from the hollow body 134. The side wall 142 and middle wall 144 of the hollow body 134 include respective slots (not shown) extending downwardly from the open upper end 136 for receiving the folded section of the upper cable 18, and permit same to pass therethrough. Fastening means 169 are used to secure the upper cable 18 to the hollow body 134, and other fastening means (not shown) can be optionally used to further secure the upper cable 18 to the hollow body 134 at another location. The lower cable of the net 12 has a similar configuration and is similarly attached to the rigid side marginal strip 126, and will not therefore be redundantly described. A pair of cover plates 172 are used to close the open upper end 136 and the open lower end (not shown) of the closed hollow cross-sectional configuration 146. Each of the elongate plates 157 preferably includes a short section (not shown) extending perpendicular to its major body, thereby forming an L-shaped configuration. Thus the short sections close the respective the open end 136 and open lower end (not shown) when the respective elongate plates 157 are placed in position.

It should be noted that in this embodiment the upper fabric band 22 and the lower fabric band (not shown) should terminate just outside the rigid side marginal strip 126. Alternatively, first and last slots 151 should be enlarged to a width which permits the fabric bands to pass therethrough.

Figure 7:
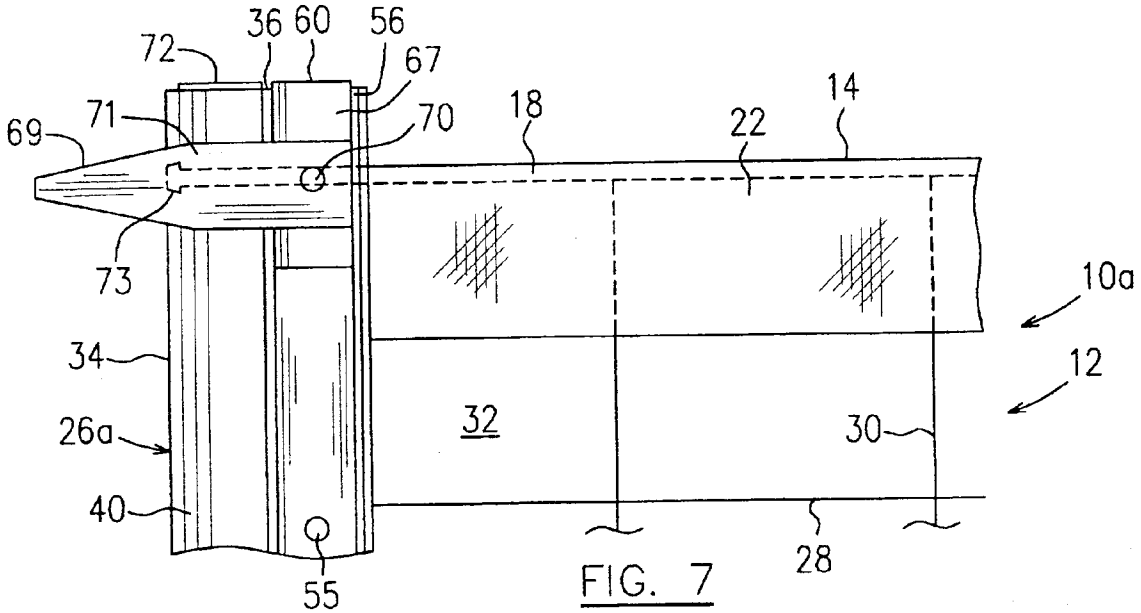
FIG. 7 is a partial side elevational view of a volleyball net assembly incorporating a further embodiment of the present invention.
Figure 8:
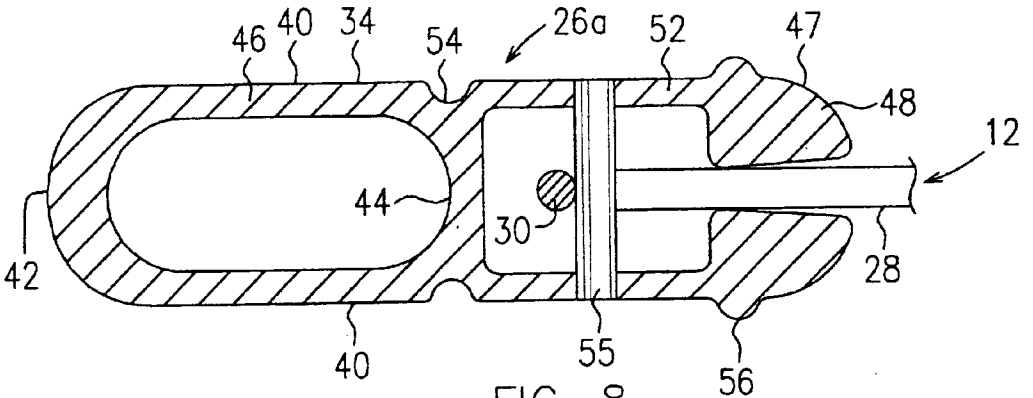
FIG. 8 is a cross-sectional view of a rigid side marginal strip in an enlarged scale, used in the volleyball net of FIG. 7.

Referring to FIGS. 7–8, a volleyball net assembly 10*a* is illustrated in a further embodiment of the present invention. The net assembly 10*a* includes the elongate and rectangular net 12 illustrated in FIG. 1, which will not be redundantly described thereinafter. The net assembly 10*a* further includes a rigid side marginal strip 26*a* which is similar to the rigid side marginal strip 26 illustrated in FIG. 1, with the following differences which will be described in detail below. For ease of comparison, similar components and features will be indicated by similar numerals, and will not be redundantly described.

The rigid side marginal strip 26*a* does not include the elongate lock member 62 of FIG. 3, and the hollow body 34 does not include the stop members 58 of FIG. 2. Alternatively, the hollow body 34 does include a plurality of spaced pins 55 extending across the open hollow cross-sectional configuration 52 of the hollow body 34, to be snugly received in individual openings (not indicated) in the respective major walls 40. The spacing between the adjacent pins 55 is substantially equal to the spacing between the adjacent horizontal strands 28 of the net 12, such that the spaced pins 55 extend through every mesh opening 32 adjacent to the outer-most vertical strand 30 of the net when the side end of the net 12 is held within the open hollow cross-sectional configuration 52 of the hollow body 34 by the spaced pins 55.

The end of the upper cable 18 extends through an opening (not shown) in the middle wall 44 and is received in an opening (not shown) in the side wall 42, and is then secured to the side wall 42 by a fastener 73. A U-shaped bracket 69 having a pair of spaced legs 71 (only one shown) is attached to the hollow body 34 at the upper end 36 thereof, preferably aligning with the upper cable 18 in a manner such that the hollow body 34 is disposed between the spaced legs 71 of the U-shaped bracket 69, and the legs 71 are secured together with the U-shaped cap 60, to the hollow body 34, by rivet 70. At the lower end (not shown) of the hollow body 34, a similar configuration is provided for attachment of the end of the lower cable to the U-shaped bracket at the lower end of the rigid side marginal strip 26*a*.

The pins 55 in FIG. 8 and the pins 155 in FIG. 6 can be replaced by a plurality of rivets, such that the pre-drilled openings in the major walls 40 in FIG. 8 and in the elongate plates 157 in FIG. 6, require less accuracy.

Modifications and improvements to the above-described embodiments of the present invention may become apparent to those skilled in the art. For example, the lower folded fabric band 24 may be omitted, other attachment means rather than rings 68, 168 or brackets 69, may be used, etc. The foregoing description is intended to be exemplary rather than limiting. The scope of the invention is therefore intended to be limited solely by the scope of the appended claims.

I claim:

1. A net adapted to be supported in a tensioned condition for sport games comprising:

a flexible upper edging and a flexible lower edging, both extending in a substantially horizontal direction;

opposed rigid side marginal strips, both extending in a substantially vertical direction;

a plurality of equally spaced horizontal strands extending between the opposed rigid side marginal stripe, and a plurality of equally spaced vertical strands extending between the upper and lower edgings, thereby defining a plurality of mesh openings of the net; and each of the rigid side marginal strips including:

an elongate, substantially flat and rigid hollow body for receiving an outer-most vertical strand disposed at one side of the net, and securing means for passing through every mesh opening adjacent to that outer-most vertical strand and being secured to the rigid hollow body.

2. A net as claimed in claim 1 wherein the body comprises open upper and lower ends, and two spaced-apart major walls extending between the upper and lower ends, and thereby defining a closed hollow cross-sectional configuration at an external side thereof for reinforcing the body, and an open hollow cross-sectional configuration at an inner side thereof for receiving that outer-most vertical strand and for engaging the securing means.

3. A net as claimed in claim 2 wherein the rigid side marginal strip comprises means or securing net cables which are attached to the respective upper and lower edgings.

4. A net as claimed in claim 3 wherein the open hollow cross-sectional configuration of the body comprises a pair of stop members extending from the respective major walls towards to each other in a spaced-apart relationship, and an elongate opening extending through the entire length of the body from the upper end to the lower end, permitting the outer-most vertical strand and connected sections of the horizontal strands to enter therethrough into the inside of the open hollow cross-sectional configuration; and wherein the securing means comprise an elongate lock member having a plurality of spaced slots extending inwardly from one side thereof for receiving the respective horizontal strands to extend therethrough, the lock member holding the outer-most vertical strand and being snugly disposed between the respective major walls and abutting the stop members.

5. A net as claimed in claim 4 wherein the elongate lock member has a length shorter than the length of the body in order to permit net cables attached to the respective upper and lower edgings to extend thereover at opposed ends, respectively.

6. A net as claimed in claim 3 wherein the open hollow cross-sectional configuration of the body comprises a plurality of spaced openings in the respective major walls, and an elongate opening extending through the entire length of the body from the upper end to the lower end, permitting the outer-most vertical strand and connected section of the horizontal strands to enter therethrough into the inside of the open hollow cross-sectional configuration; and wherein the securing means comprise a plurality of pine extending through every mesh opening adjacent to the outer-most vertical strand and being received at opposed ends thereof in the openings in the respective major walls.

7. A net as claimed in claim 3 wherein the open hollow cross-sectional configuration of the body comprises a plurality of spaced openings in one of the major walls, an elongate opening in the other of the major walls extending through the entire length of the body from the upper end to the lower end, and a plurality of spaced slots defined in the other of the major wall and extending substantially horizontally from the elongate opening towards the inner side of the body, thereby permitting the outer-most vertical strand and connected sections of the horizontal strands to enter into the inside of the pen hollow cross-sectional configuration and wherein the securing means comprise a plurality of paced pins extending through the respective openings in one of the major walls, through every mesh opening adjacent to the outer-most vertical, strand, and through the elongate opening in the other of the major walls, and a pair of elongate plates abutting the respective major walls at an outer surface thereof, the elongate plates being secured to the pins at opposed ends thereof.

8. A net as claimed in claim 7 wherein the major walls defining the open hollow cross-sectional configuration comprise a pair of major areas recessed inwardly for receiving the respective elongate plates.

9. A net as claimed in claim 2 wherein the rigid side marginal strip comprises a pair of covers for closing the respective open upper and lower ends.

* * * * *